US008540315B2

(12) United States Patent
Piretti

(10) Patent No.: US 8,540,315 B2
(45) Date of Patent: Sep. 24, 2013

(54) NESTABLE CHAIR WITH SEAT ROTATION AND STOP ARRANGEMENT

(75) Inventor: Giancarlo Piretti, Bologna (IT)

(73) Assignee: Pro-Cord S.p.A., Bologna (IT)

( * ) Notice: Subject to any disclaimer, the term of this patent is extended or adjusted under 35 U.S.C. 154(b) by 253 days.

(21) Appl. No.: 12/691,037

(22) Filed: Jan. 21, 2010

(65) Prior Publication Data

US 2011/0175412 A1 Jul. 21, 2011

(51) Int. Cl.
*A47C 1/00* (2006.01)

(52) U.S. Cl.
USPC ..... 297/335; 297/239; 297/331

(58) Field of Classification Search
USPC ..... 297/239, 335, 331, 332, 333, 336, 297/234, 243, 257, 232
See application file for complete search history.

(56) References Cited

U.S. PATENT DOCUMENTS

| | | | | |
|---|---|---|---|---|
| 1,152,480 | A * | 9/1915 | Bouk | 297/332 |
| 3,111,344 | A | 11/1963 | Hoven et al. | |
| D202,264 | S | 9/1965 | Albinson et al. | |
| D214,315 | S | 6/1969 | Bartholomew | |
| D272,587 | S | 2/1984 | Pamberg | |
| D274,771 | S | 7/1984 | Ambasz et al. | |
| D284,048 | S | 6/1986 | Ambasz et al. | |
| D289,120 | S | 4/1987 | Chadwick et al. | |
| D292,149 | S | 10/1987 | Monesi | |
| 4,733,910 | A | 3/1988 | Brennan | |
| D298,390 | S | 11/1988 | Bellini | |
| D299,192 | S | 1/1989 | Chadwick et al. | |
| D300,885 | S | 5/1989 | Ochsner | |
| D305,285 | S | 1/1990 | Piretti | |
| D352,183 | S | 11/1994 | Sheridan | |
| D370,360 | S | 6/1996 | Fewchuk | |
| 5,524,966 | A * | 6/1996 | Piretti | 297/301.3 |
| D374,561 | S | 10/1996 | Meijer | |
| 5,580,127 | A * | 12/1996 | Piretti | 297/301.3 |
| D378,553 | S | 3/1997 | Newhouse | |
| D385,425 | S | 10/1997 | Goetz | |

(Continued)

FOREIGN PATENT DOCUMENTS

CH 3670498 A 3/1963

OTHER PUBLICATIONS

Pending U.S. Appl. No. 29/319,333, filed Jun. 6, 2008 entitled "Chair", Giancarlo Piretti.
EP Search Report dated Apr. 15, 2011.

*Primary Examiner* — David E Allred
(74) *Attorney, Agent, or Firm* — Andrus, Sceales, Starke & Sawall, LLP

(57) ABSTRACT

A nesting chair includes a base having a transverse member. A backrest and seat are interconnected with the base. A seat rotation mechanism is configured to allow the seat to rotate from an initial seating position to an upwardly rotated nesting position. The seat rotation includes a first bearing area defined by an underside of the seat, and a second bearing area defined by a separate bearing member. The first and second bearing areas are located on opposite sides of the transverse member. A retainer arrangement is used to secure the bearing member to the seat with the transverse member therebetween. The seat is rotatable about the transverse member from the initial seating position to the upwardly rotated nesting position to enable the nesting chair to be nested with a plurality of like chairs. The transverse member is provided with a stop engageable with the seat for maintaining the seat in the seating position.

12 Claims, 7 Drawing Sheets

(56) References Cited

U.S. PATENT DOCUMENTS

| | | | | | |
|---|---|---|---|---|---|
| D411,928 | S | * | 7/1999 | Ritch et al. | D6/500 |
| D417,970 | S | | 12/1999 | Duffy et al. | |
| 6,030,037 | A | * | 2/2000 | Ritch et al. | 297/239 |
| D433,578 | S | | 11/2000 | Saul | |
| 6,142,566 | A | * | 11/2000 | Ritch et al. | 297/239 |
| D435,977 | S | * | 1/2001 | Ambasz | D6/368 |
| D436,751 | S | | 1/2001 | Schacht | |
| D440,784 | S | * | 4/2001 | Ambasz | D6/368 |
| D446,037 | S | | 8/2001 | Koepke et al. | |
| D446,661 | S | * | 8/2001 | Ambasz | D6/368 |
| 6,286,901 | B1 | * | 9/2001 | Ritch et al. | 297/313 |
| D451,693 | S | | 12/2001 | Pearce et al. | |
| D455,570 | S | | 4/2002 | Kita | |
| D457,739 | S | | 5/2002 | Pearce et al. | |
| 6,412,869 | B1 | | 7/2002 | Pearce | |
| 6,481,789 | B1 | * | 11/2002 | Ambasz | 297/55 |
| D469,971 | S | * | 2/2003 | Piretti | D6/374 |
| 6,669,301 | B1 | | 12/2003 | Funk et al. | |
| 6,755,468 | B1 | | 6/2004 | Pan | |
| D509,671 | S | | 9/2005 | Olson et al. | |
| D509,969 | S | | 9/2005 | Loew et al. | |
| D515,331 | S | | 2/2006 | Piretti | |
| 7,118,177 | B2 | | 10/2006 | Piretti | |
| D535,838 | S | * | 1/2007 | Ritch et al. | D6/500 |
| D540,559 | S | | 4/2007 | Neil | |
| D546,085 | S | * | 7/2007 | Ritch et al. | D6/366 |
| D548,475 | S | * | 8/2007 | Ritch et al. | D6/368 |
| 7,794,016 | B1 | * | 9/2010 | Lucci et al. | 297/331 |
| 2003/0090137 | A1 | * | 5/2003 | Piretti | 297/335 |
| 2003/0164635 | A1 | | 9/2003 | Battey et al. | |
| 2003/0205923 | A1 | * | 11/2003 | Haney et al. | 297/335 |
| 2005/0264060 | A1 | | 12/2005 | Cesaroni et al. | |
| 2007/0120406 | A1 | * | 5/2007 | Piretti | 297/331 |
| 2007/0222266 | A1 | * | 9/2007 | Lucci et al. | 297/331 |
| 2009/0079235 | A1 | | 3/2009 | Huang | |
| 2010/0194160 | A1 | * | 8/2010 | Machael et al. | 297/239 |
| 2010/0327643 | A1 | * | 12/2010 | Lucci et al. | 297/239 |
| 2011/0187169 | A1 | * | 8/2011 | Stewart et al. | 297/332 |

* cited by examiner

NESTABLE CHAIR WITH SEAT ROTATION AND STOP ARRANGEMENT

FIELD OF THE INVENTION

The present disclosure generally relates to a chair, and more particularly, pertains to a chair configured to provide for a horizontal nesting arrangement.

BACKGROUND OF THE INVENTION

It is known to provide a nestable chair or system of nestable chairs, in which, for purposes of compact storage, one chair is received within another chair. Arrangement for vertically nestable or "stacking" chairs where one chair is fitted atop another chair to form a vertical stack of chairs are well known. Typically, such vertically nestable chairs will include a backrest and a generally orthogonal base (i.e. a box-shaped base consisting of at least two and typically four leg supports) which is configured so that one chair can be fitted onto another chair in a compact arrangement, with the base of the upper chair fitting over the seat of the lower chair.

Arrangements for horizontally nestable chairs, where one chair is fitted into another chair to form a horizontal line of chairs, are also known. Such horizontally nestable chairs typically also include a base formed by four leg supports. Horizontally nestable chairs are known to provide a rotation or flip mechanism for enabling pivotal movement of the seat relative to the backrest between an initial seating position and an upwardly rotated nesting position. In addition, one or more stops are included on the chair for supporting the seat in the seating position.

It remains desirable to provide a horizontally nestable chair that provides for relatively compact storage with an improved seat rotation and stop arrangement.

SUMMARY OF THE INVENTION

The present disclosure relates to a nesting chair including a base having a transverse member. A backrest and a seat are interconnected with the base. A seat rotation mechanism is disposed between the base and the seat, and is configured to allow the seat to rotate from an initial seating position to an upwardly rotated nesting position. The seat rotation mechanism includes a first bearing area defined by an underside of the seat, and a second bearing area defined by a separate bearing member. The first and second bearing areas are located on opposite sides of the transverse member. A retainer arrangement is interconnected with the bearing member and the seat to secure the bearing member to the seat with the transverse member therebetween. The seat is rotatable about the transverse member from the generally horizontal seating position to the upwardly rotated nesting position to enable the nesting chair to be nested with a plurality of like chairs. The transverse member is provided with a stop engageable with the seat for maintaining the seat in the seating position.

In one embodiment, the stop is defined by a U-shaped tube fixed to and extending forwardly of the transverse member. The base includes a set of legs extending downwardly from the transverse member. The base also includes backrest supports for supporting the backrest therefrom. The seat includes an upper portion and a lower portion with a set of reinforcing plates interposed between the upper and lower portions. The underside of the seat includes a bearing saddle defining a first concave bearing surface extending longitudinally of the bearing saddle. The bearing member defines a second concave bearing surface extending longitudinally of the bearing member. The first and second bearing surfaces are engageable with an outer surface of the transverse member. The first and second bearing surfaces include bearing collar segments engageable with the outer surface of the transverse member. The bearing collar segments and the transverse member receive a roll pin for maintaining a centering position of the seat relative to the transverse member. The retainer arrangement preferably includes a set of fasteners having end portions secured to the reinforcing plates positioned between the upper and lower portions of the seat. The stop is engageable with the underside of the seat forwardly of the first and second bearing areas. The first and second bearing areas are engageable with the transverse member along substantially the entire length thereof.

BRIEF DESCRIPTION OF THE DRAWINGS

The best mode of carrying out the disclosure is described herein below with reference to the following drawing figures.

DETAILED DESCRIPTION OF THE INVENTION

Figure 1:
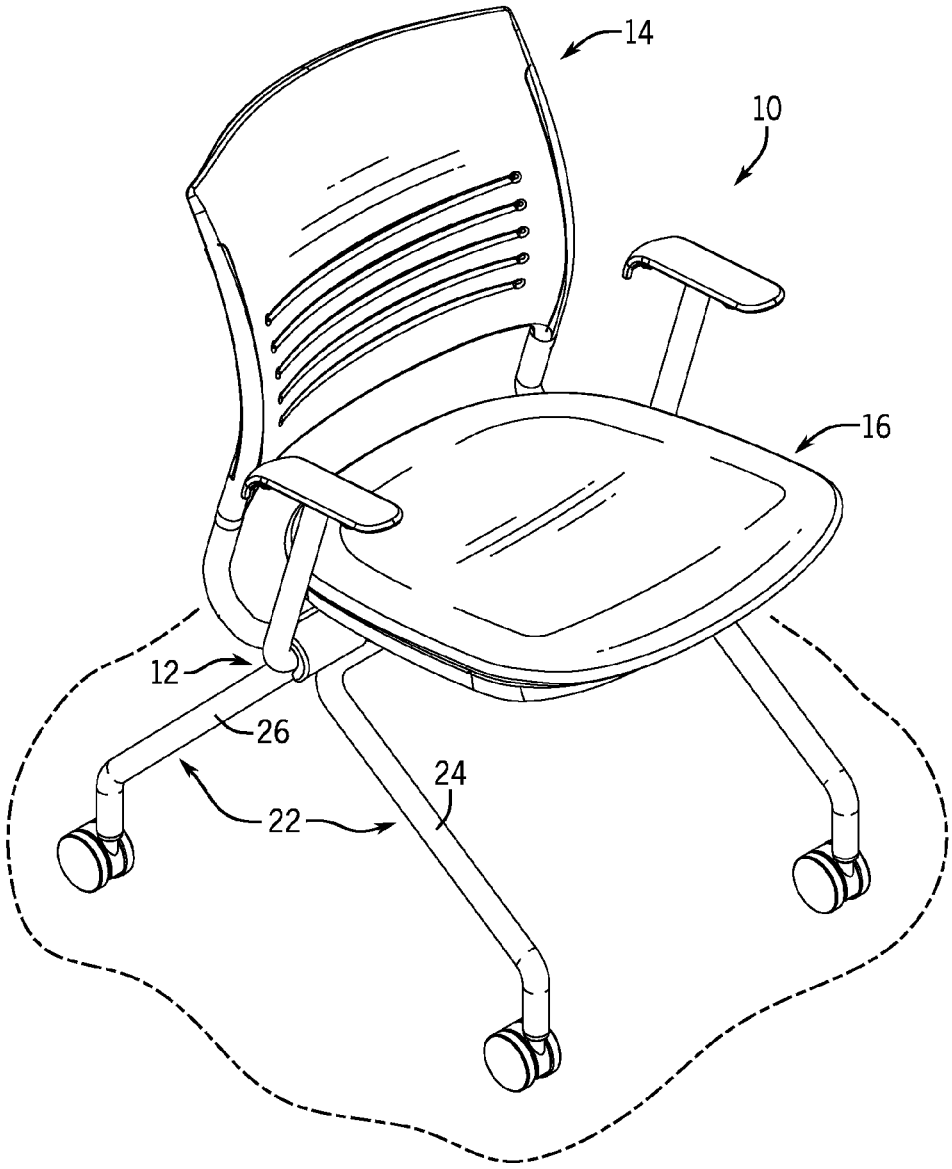
FIG. 1 is a perspective view of a nesting chair having a seat rotation and stop arrangement in accordance with the present disclosure.

Referring to the drawings, FIGS. 1-9 illustrate a nestable chair 10 having a seat rotation and stop arrangement in accordance with the present disclosure. The chair 10 is generally comprised of a base 12, a backrest 14, a cantilevered seat 16, and a seat rotation mechanism 18 for pivotally moving the seat 16 from a generally horizontal seating position to a generally upright storage position. When in the storage position, a number of like chairs 10 may be conveniently nested together for storage.

Figure 2:
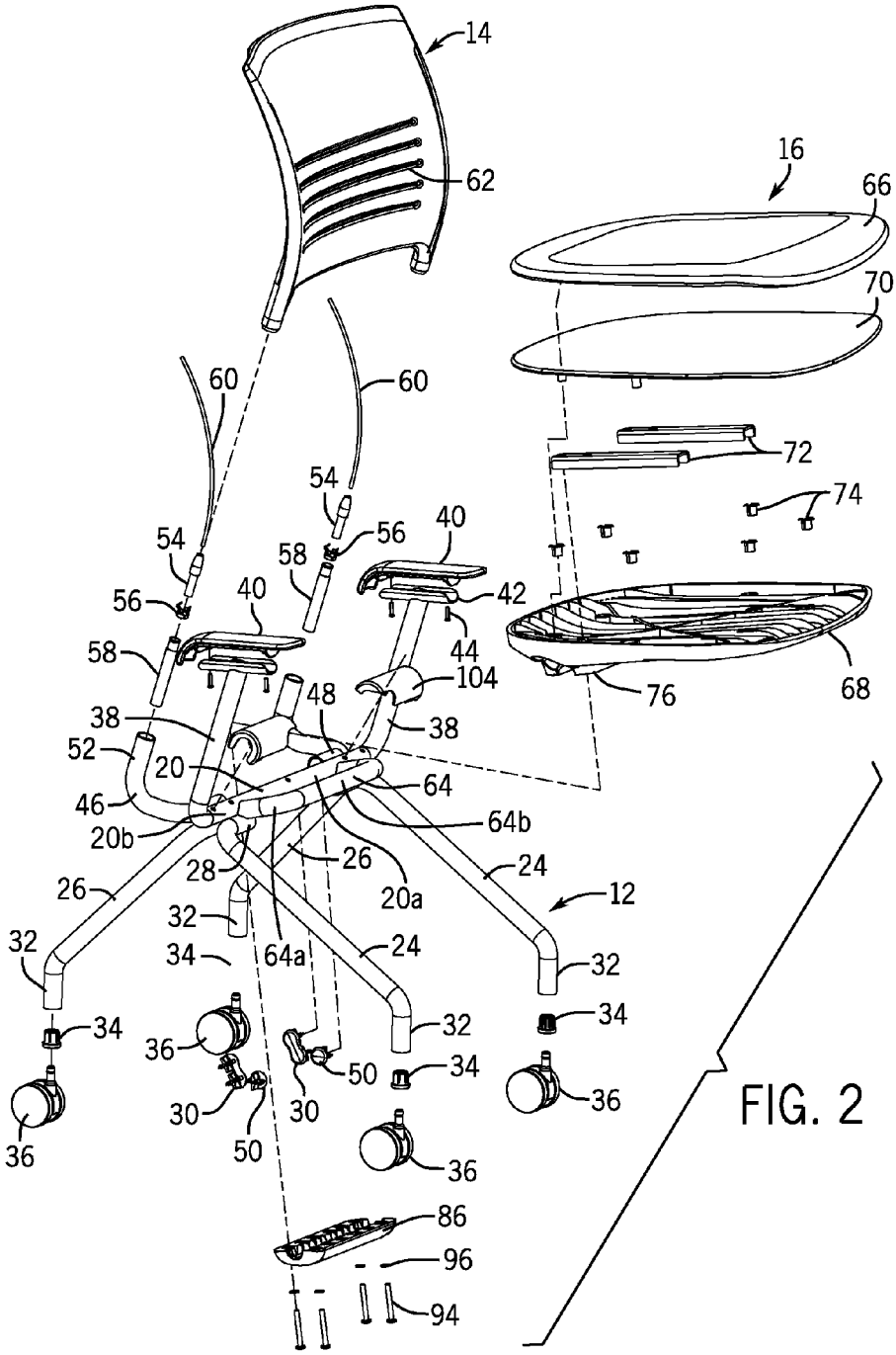
FIG. 2 is an exploded view of the nesting chair show in FIG. 1.

Referring initially to FIGS. 1 and 2, the base 12 provides a support structure for the chair 10, and generally includes a single crossmember 20 preferably in the form of a horizontally and linearly extending or transverse straight tube. The transverse tube 20 has a medial portion 20*a* and a pair of spaced outer ends 20*b*. The crossmember 20 is interconnected, such as by welding, to a set of legs 22 extending downwardly from the tube 20 for supporting the chair 10 on a floor or other support surface. The legs 22 are typically formed by a pair of forwardly extending tubular leg members 24, and a pair of rearwardly extending tubular leg members 26. Each pair of leg members 24, 26 has upper end portions 28 that extend inwardly of opposite ends of the tube 20, and are fixed to the bottom of the tube 20 adjacent each other. The upper end portions 28 have open ends that are closed such as by plugs 30 that are frictionally retained by inner walls of the upper end portions 28. Each pair of leg members 24, 26 has lower end portions 32 with open ends that extend downwardly and receive bushings 34 and caster wheels 36 configured to swivel and provide movement of the chair 10 on the floor. Although not illustrated, the disclosure contemplates that other leg arrangements may be interconnected to the tube 20.

In the example shown in the drawings, the tube 20 additionally provides support for a pair of upwardly extending arm rest supports 38 configured to receive and secure a pair of arm rests 40 on corresponding arm rest brackets 42 using fasteners 44. Arm rest supports 38 may be integrally formed with the tube 20, or may be separate members that are received and secured within open ends of the tube 20 to support the arm rest 40.

A pair of curved tubular backrest supports 46 is mounted on the base 12 for supporting the backrest 14 therefrom. The backrest supports 46 have open lower end portions 48 that are welded or similarly affixed to rear surfaces of the opposite ends of the tube 20 with the open lower end portions 48 being closed such as by plugs 50. The backrest supports 46 have open upper end portions 52 that hold elongated receivers 54, coil springs 56 and bushings 58 adapted to retain backrest support springs 60 configured to be received within elongated passages formed within the backrest 14. Accordingly, the backrest 14 is designed to be relatively flexible such that it may flex or tilt rearwardly with respect to base 12. In addition, a set of horizontal slots 62 extend across a portion of the backrest 14 to provide the backrest 14 with increased flexibility. The backrest 14 is typically constructed out of a plastic such as, for example, polypropylene or similar such materials, and may be additionally upholstered, if desired.

The base 12 further provides a seat stop 64 for supporting the seat 16 in the operative or down seating position. In the embodiment shown, the seat stop 64 takes the form of a U-shaped tube which is welded or otherwise affixed to the crossmember 20, and extends forwardly and slightly upwardly therefrom between the forwardly extending legs members 24. The U-shaped tube 64 has outer legs **64*a* fixed to the outer ends 20*b* of the transverse member 20, and a bridge section 64*b* connecting the legs 64*a* and extending substantially parallel to the medial portion 20*a* of the transverse member 20. It should be understood that the seat stop 64 may alternatively be formed from more than one member fixed to the tube 20**.

Figure 4:
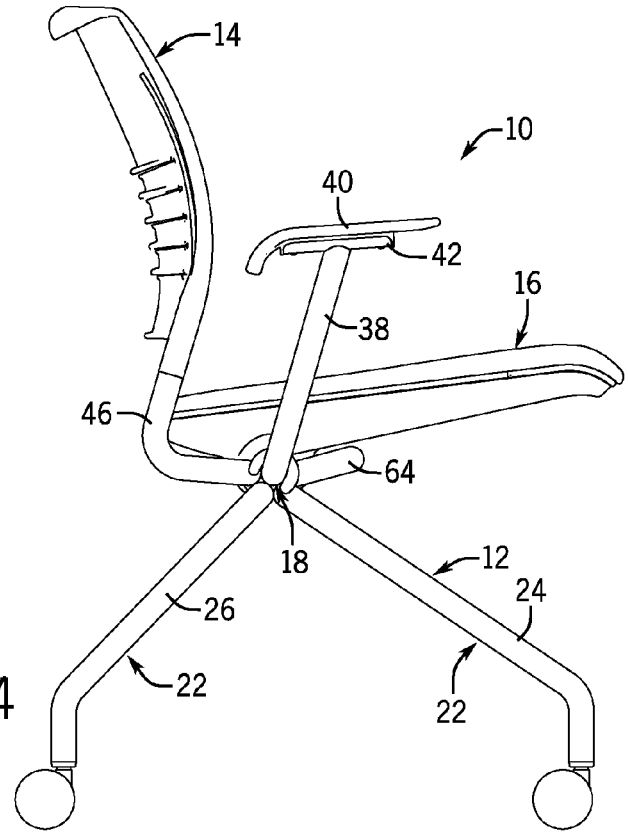
FIG. 4 is a side view of the nesting chair shown in FIG. 1 in a seating position.
Figure 5:
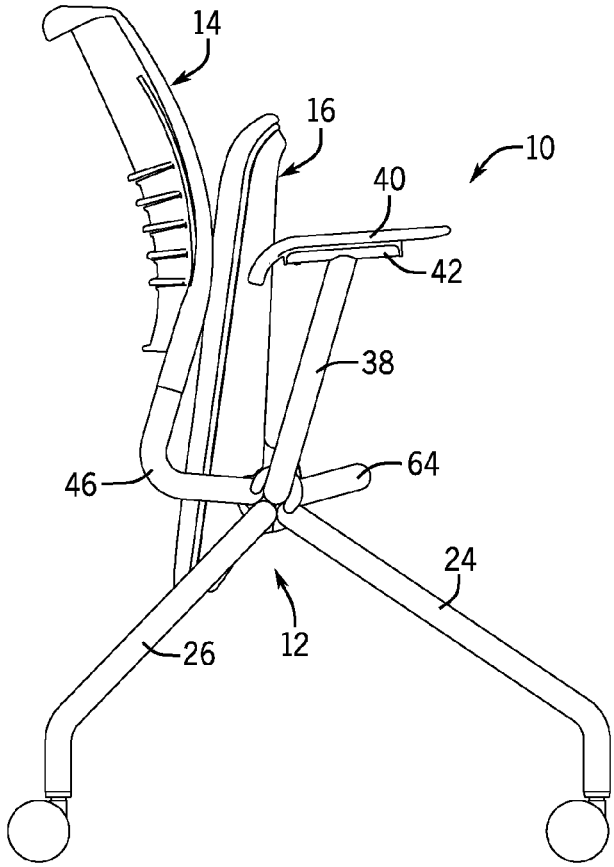
FIG. 5 is a view similar to FIG. 4 showing the nesting chair in an upwardly rotated nesting position.
Figure 6:
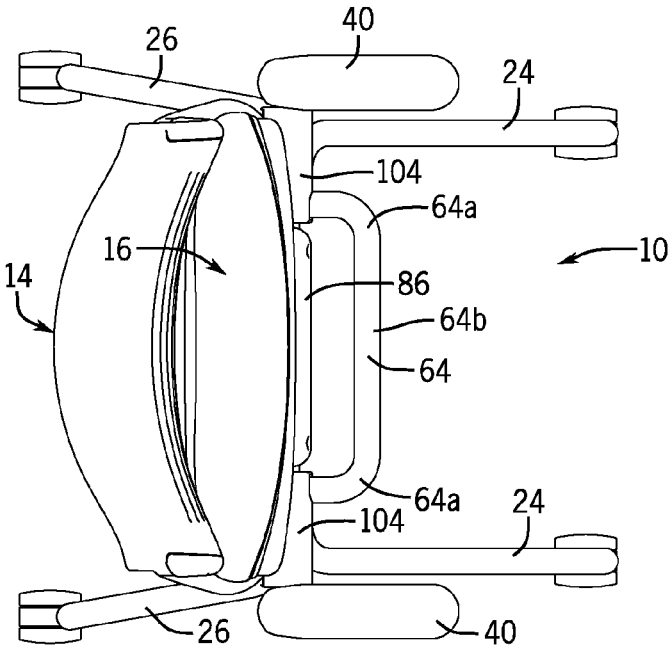
FIG. 6 is a top view of FIG. 5.
Figure 7:
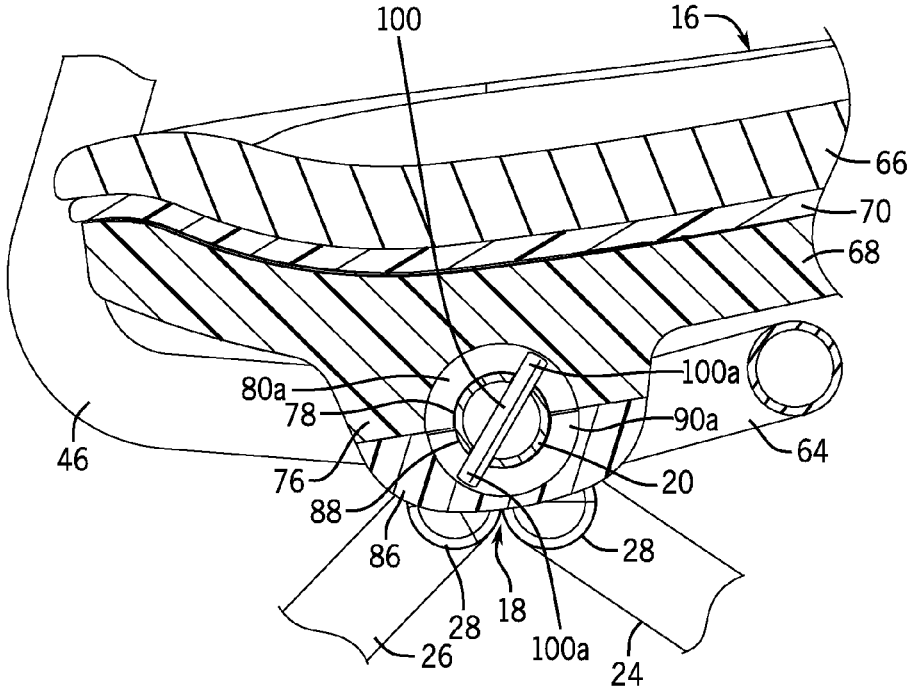
FIG. 7 is an enlarged fragmentary sectional view showing the seat rotating mechanism.
Figure 8:
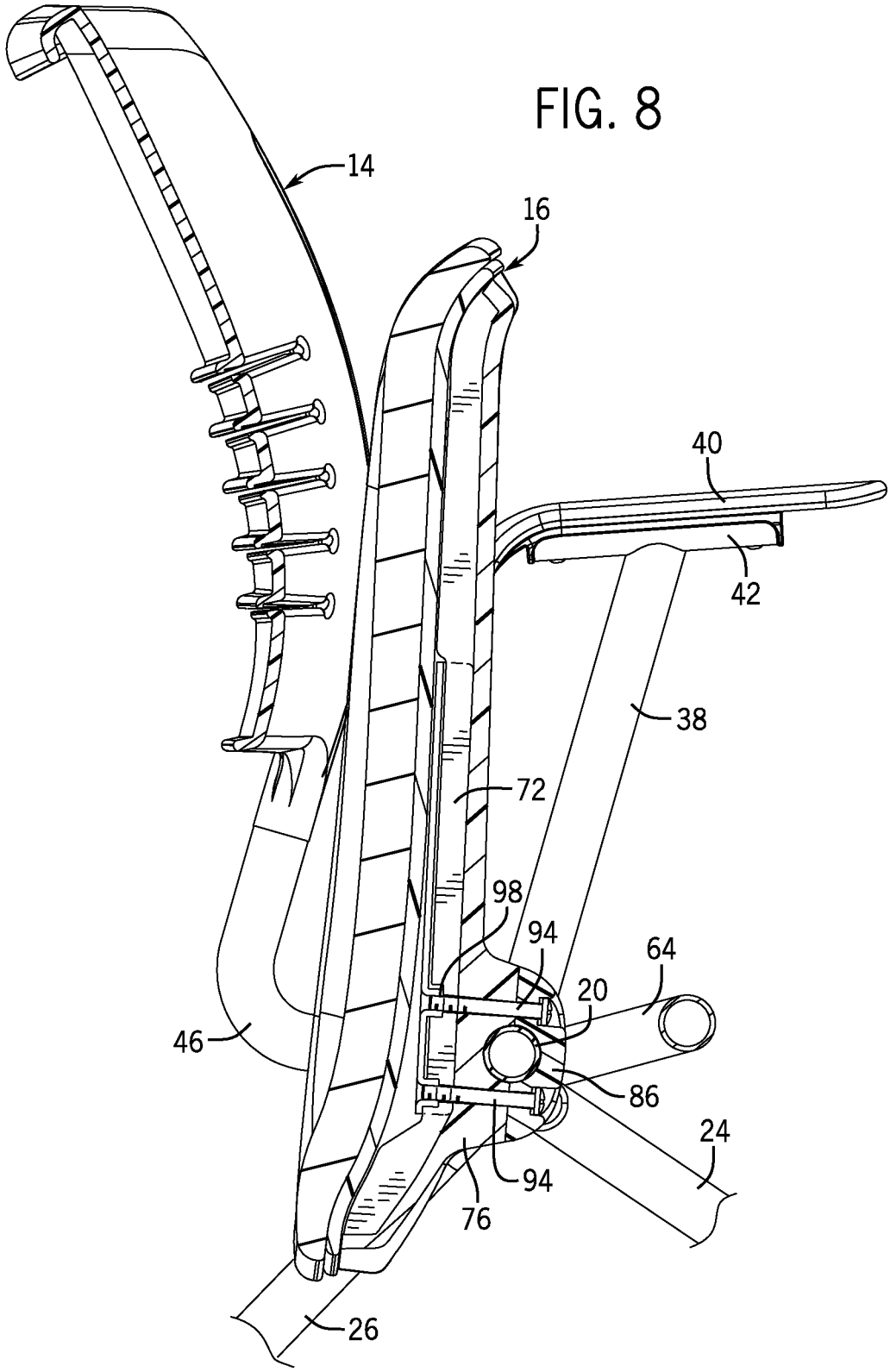
FIG. 8 is an enlarged fragmentary sectional view of the nesting chair in the nesting position shown in FIG. 5.
Figure 9:
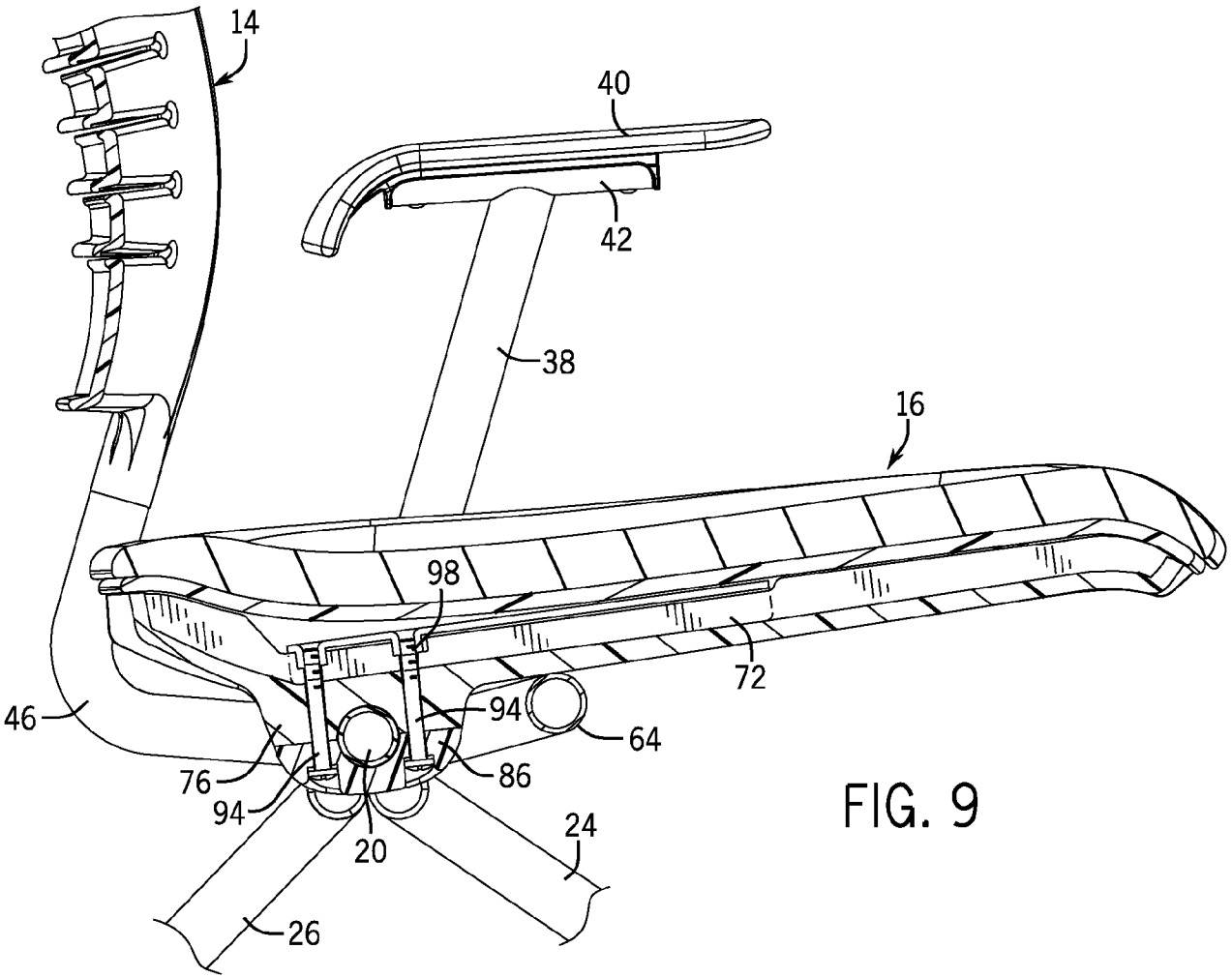
FIG. 9 is an enlarged fragmentary sectional view of the nesting chair in the seating position shown in FIG. 4.

Referring to FIGS. 7-9, the seat rotation mechanism 18 is configured to allow the seat 16 to be manually rotated or flipped from the operative or down seating position shown in FIGS. 1, 4 and 9 to the generally vertical storage position shown in FIGS. 5, 6 and 8 in which position a group of like chairs may be horizontally nested together. The crossmember or horizontal tube 20 serves as the surface about which seat rotation mechanism 18 rotates the seat 16 of the chair 10 as will be described in further detail below.

The seat 16 includes an upper portion 66, a lower portion or shroud 68, and a liner 70 interposed between the upper and lower portions 66, 68. If desired, the liner 70 may be upholstered with foam and fabric. As seen in FIGS. 2 and 9, a pair of reinforcing plates 72 are trapped between the shroud 68 and liner 70 which are held together by a plurality of clips 74. The shroud 68 and the retaining plates 72 provide the structural support for the seat rotation mechanism 18 as the seat 16 rotates about the tube 20.

Figure 3:
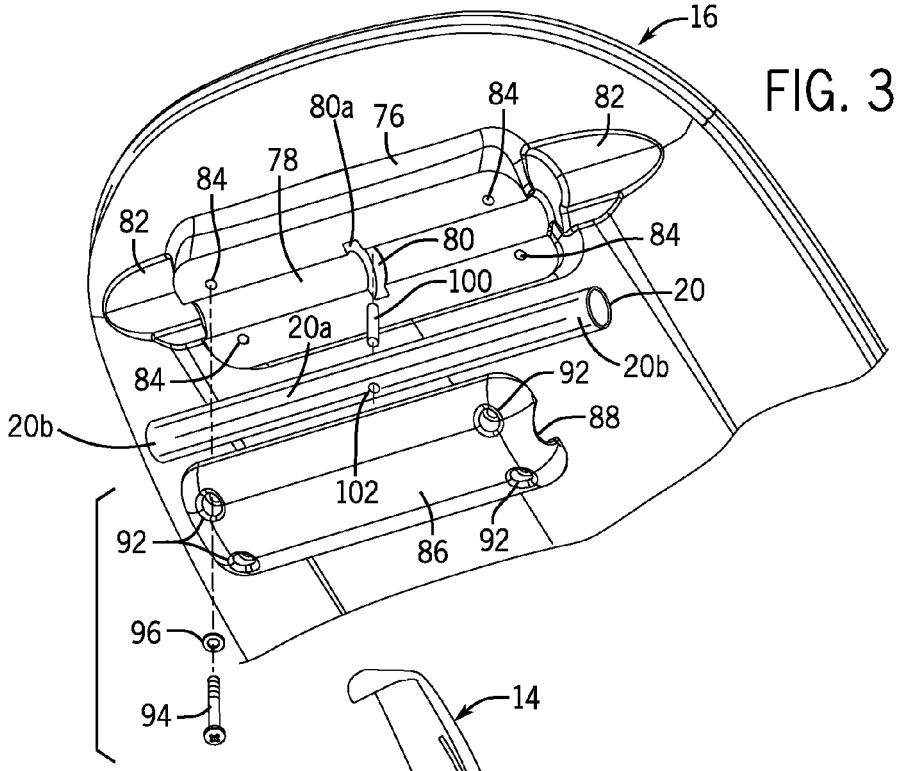
FIG. 3 is an enlarged, exploded, detailed view of a bottom portion of a seat employed in the nesting chair of FIG. 1.

Referring now to FIG. 3, the underside of shroud 68 is integrally constructed with a bearing saddle 76 formed with an elongated concave recess 78 defining a first semi-cylindrical bearing surface. The saddle 76 also includes a first bearing collar segment 80 formed with a semi-cylindrical configuration and located in the center of the first bearing surface 78. The saddle 76 is further configured with a pair of extensions 82 on opposite ends thereof, and a set of apertures 84 provided on opposite sides of the first bearing surface 78. A bearing cap 86 is constructed with an elongated concave recess 88 defining a second semi-cylindrical bearing surface complimentary to the first bearing surface 78. The bearing cap 86 also includes a second semi-cylindrical bearing collar segment 90 adapted to mate with the first bearing collar segment 80 and is positioned centrally of the second bearing surface 88. The bearing cap 86 is formed with a number of openings 92 alignable with the apertures 84 in the bearing saddle 76. The bearing cap 86 is designed to be mated against the saddle 76 with the crossmember or tube 20 interposed therebetween such that the bearing surfaces 78, 88 and the bearing collar segments 80, 90 are engaged for relative rotation with respect to the outer cylindrical surface of the tube 20 as seen in FIGS. 7, 8 and 9. The bearing collar segments 80, 90 are formed internally with mating slots **80*a*, 90*a*, respectively, defined by walls that surround and enclose the outer surfaces of transverse member 20. The bearing cap 86 is fastened to the saddle 76 by passing a series of bolts 94 through washers 96, openings 92, and apertures 84, and securing threaded ends of the bolts 94 in threaded holes 98 formed in the end portions of the retaining plates 72 as seen in FIGS. 2, 8 and 9. A roll pin 100 (FIG. 7 extends through aligned recesses 102 formed in an outer wall of the medial portion 20*a* of crossmember 20 and has end portions 100*a* projecting into the slots 80*a*, 90*a* of the mating bearing collar segments 80, 90 and engaging side walls of the slots 80*a*, 90*a* to maintain the position of the seat 16 on center so that there is no lateral movement of the seat 16. By this arrangement, the transverse member 20 and the roll pin 100 are circumferentially surrounded within the bearing saddle 76 on seat 16 and the bearing cap 86. Bearing covers 104 are provided over the saddle extensions 82 and around outer ends of the crossmember 20 and the seat stop 64 as best seen in FIGS. 1 and 6**.

With this construction, the seat 16 rotates about the crossmember 20 between the down position (useful as a seat) shown in FIGS. 1, 4 and 9, and the up position shown in FIGS. 5, 6 and 8 (allowing nesting of chairs). It should be appreciated that the first and second bearing surfaces 78, 88 define a large bearing area extending substantially the entire length of the medial portion **20*a* of crossmember 20 as the seat 16 rotates about the tube 20. In addition, the reinforcing plates 72 further enable bearing support for the seat rotation mechanism 18. In the down position, the seat 16 is effectively stopped from rotation by the seat stop 64 welded to the crossmember 20. In the up position, rotation of the seat 16 is stopped by the contact of the seat 16 with the backrest 14. Slots 80*a*, 90*a* are continuous so that the bearing elements 76, 86 can rotate freely between the up and down stop positions of the seat 16 defined by the back rest 14 and the stop 64**.

Accordingly, the seat rotation and stop arrangement of the chair 10 provides a relatively simple and cost effective method for enabling nesting a number of chairs, and conveniently providing a solid structural element on which the cantilevered load of the seat 16 bears when the chair is in the seating position.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

What is claimed is:

1. A nesting chair comprising:

a base including a straight transverse member fixedly interconnected directly thereto and having a medial portion located between a pair of spaced outer ends;

a backrest and seat interconnected with the base;

a seat rotation mechanism disposed between the base and the seat configured to allow the seat to rotate from a seating position to an upwardly rotated nesting position, wherein the seat rotation mechanism includes a first bearing area defined by and formed within an underside of the seat, a second bearing area defined by a separate bearing member, wherein the first and second bearing areas are located on opposite sides of and rotatably engaged with an outer cylindrical surface of the medial portion of the transverse member, a retainer arrangement interconnected with the bearing member and seat to secure the bearing member to the seat with the transverse member therebetween, wherein the first and second bearing areas and the seat are rotatable about the transverse member from the initial seating position to the upwardly rotated nesting position to enable the nesting chair to be nested with a plurality of like chairs, wherein the transverse member is provided with a stop engageable with the seat for maintaining the seat in the seating position, wherein the first and second bearing areas each include a bearing collar segment that includes a semi-circular continuous mating slot defined by a pair of spaced walls, wherein the bearing collar segments mate with each other such that the bearing collar segments and the mating slots fully surround the outer surface of the transverse member; and a roll pin for maintaining a centering position and preventing lateral movement of the seat relative to the transverse member, wherein the roll pin extends through the medial portion of the transverse member and has outer end portions that project into and are received within the mating slots of the bearing collar segments, wherein the transverse member is circumferentially surrounded between the first and second bearing areas and the seat is rotatable about the transverse member during which rotation the outer end portions of the roll pin travel within the mating slots of the bearing collar segments.

2. The nesting chair of claim 1, wherein the stop is defined by a U-shaped tube fixed to and extending forwardly and upwardly of the transverse member, the U-shaped tube having outer legs joined to the outer ends of the transverse member, and a bridge section extending substantially parallel to the medial portion of the transverse member.

3. The nesting chair of claim 1, wherein the base includes a set of legs extending downwardly from and fixed directly to the transverse member.

4. The nesting chair of claim 1, wherein the base includes backrest supports for supporting the backrest therefrom.

5. The nesting chair of claim 1, wherein the seat includes a liner located between an upper portion and a lower portion with a set of reinforcing plates interposed between the liner and the lower portion.

6. The nesting chair of claim 1, wherein the underside of the seat includes a bearing saddle defining a first concave bearing surface extending longitudinally of the bearing saddle.

7. The nesting chair of claim 6, wherein the bearing member defines a second concave bearing surface extending longitudinally of the bearing member.

8. The nesting chair of claim 5, wherein the retainer arrangement includes a set of fasteners secured to end portions of the reinforcing plates positioned between the liner and the lower portion of the seat.

9. The nesting chair of claim 1, wherein the stop is engageable with the underside of the seat forwardly of the first and second bearing areas.

10. The nesting chair of claim 1, wherein the first and second bearing areas are continuously engageable with the transverse member along a length of the medial portion thereof.

11. The nesting chair of claim 3, wherein the stop is located between the legs of the base.

12. A nesting chair comprising:

a base including a straight transverse member fixedly interconnected directly thereto and having a medial portion located between a pair of spaced outer ends;

a backrest interconnected with the base;

a seat movably connected with the base; and, a seat rotation and stop arrangement associated with the transverse member and configured to allow the seat to rotate from an initial seating position defining a down stop position in which the seat is supported upon a stop fixed to the transverse member, and an upwardly rotated vertical position defining an up stop position in which the seat is engaged against the backrest, wherein the seat rotation and stop arrangement includes a bearing saddle constructed within an underside of a seat and defining a first bearing area, and a bearing cap retained against the bearing saddle and defining a second bearing area such that the first and second bearing areas rotatably engage and surround an outer cylindrical surface of the medial portion of the transverse member along a length of the medial portion thereof, wherein the bearing saddle, the bearing cap and the seat are rotatable about the transverse member from the initial seating position to the upwardly rotated vertical position to enable the nesting chair to be nested with a plurality of like chairs, wherein the bearing saddle and the bearing cap each include a mating bearing collar segment which are each formed internally with a semi-circular continuous mating slot defined by a pair of spaced walls, wherein the bearing collar segments mate with each other such that the bearing collar segments and the mating slots fully surround the outer surface of the transverse member, and a roll pin for maintaining a centering position and preventing lateral movement of the seat relative to the transverse member, wherein the roll pin extends through the medial portion of the transverse member and has outer end portions that project into and are received within the mating slots defined by the bearing collar segments, wherein the transverse member is circumferentially surrounded between the bearing saddle and the bearing cap, and wherein the roll pin travels within the continuous mating slots to enable the bearing saddle and the bearing cap to rotate freely about the transverse member between the up and down stop positions.

* * * * *